US006508666B1

(12) United States Patent
Francis

(10) Patent No.: US 6,508,666 B1
(45) Date of Patent: Jan. 21, 2003

(54) PASS-THRU ELECTRICAL CONNECTOR ASSEMBLY

(75) Inventor: Michael E. Francis, Beaver Falls, PA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/072,434

(22) Filed: Feb. 8, 2002

(51) Int. Cl.[7] ..... H01R 13/73

(52) U.S. Cl. ..... 439/548; 439/57; 439/567; 439/282; 439/54

(58) Field of Search ..... 439/546, 547, 439/548, 549, 57, 248, 342, 247, 567, 282, 357

(56) References Cited

U.S. PATENT DOCUMENTS

| | | | | | |
|---|---|---|---|---|---|
| 3,894,205 | A | * | 7/1975 | List et al. | 200/51.07 |
| 4,029,953 | A | | 6/1977 | Natoli | |
| 4,148,542 | A | | 4/1979 | Wood | |
| 4,427,255 | A | * | 1/1984 | Cox | 339/127 |
| 5,888,093 | A | * | 3/1999 | Polgar et al. | 439/546 |
| 6,083,040 | A | * | 7/2000 | Mosquera | 439/548 |

* cited by examiner

*Primary Examiner*—P. Austin Bradley
*Assistant Examiner*—Truc Nguyen
(74) *Attorney, Agent, or Firm*—Thomas N. Twomey

(57) ABSTRACT

A pass-thru electrical connector assembly is an integral part of a barrier wall which separates a harsh environment from a controlled environment. A connector body having a staged position and a locked position on the barrier wall has a flange which extends radially outward from one end of an axial projecting portion. Via rotation of the connector body from the staged position to the locked position, the projecting portion of the connector body moves axially forward through a hole of the barrier wall as a ring seal is preferably axially compressed between the flange and one side of the barrier wall. Axial movement of the connector body is achieved via a plurality of locking lugs which protrude radially outward from and are spaced circumferentially about the projecting portion of the connector body. The lugs are aligned circumferentially with a plurality of slots spaced about and communicating with the hole of the barrier wall when the connector body is in the staged position. When the connector body rotates from the staged position to the locked position, the lugs become misaligned to the slots. Simultaneously, a flex lock cantilevered from the projecting portion and disposed between two of the locking lugs snaps radially outward into one of the slots to lock the connector body to the barrier wall.

15 Claims, 4 Drawing Sheets

PASS-THRU ELECTRICAL CONNECTOR ASSEMBLY

TECHNICAL FIELD OF THE INVENTION

This invention relates to a pass-thru electrical connector assembly and more particularly to an environmentally sealed pass-thru electrical connector assembly having unsealed male terminals.

BACKGROUND OF THE INVENTION

Automotive electrical connectors often engage and pass through barrier walls which separate a harsh environment from a controlled environment. Many applications exist including the housing of an automotive headlamp or the encasement of a control module. In a headlamp application, the barrier wall is the housing of the headlamp assembly, the controlled environment is the chamber enclosed by the housing, and the harsh environment is the engine compartment which is exposed to moisture, road salts, etc. The connector must not only engage the barrier wall or housing but it must also seal to the housing thereby maintaining the integrity of the controlled environment. The controlled environment must be maintained so that the electrical terminal connections within the connector are not subject to corrosion or failure from exposure to the harsh environment.

The connector body passes through a hole formed in or through the barrier wall. Typically, this hole is substantially round with circumferentially spaced slots disposed about the perimeter of the hole. When engaging the connector body to the housing, radial protrusions of the connector body align with the slots of the hole and are moved axially through the slots. Rotation of the connector body fixes the connector body to the housing axially. Additional means and features are incorporated to lock the connector body to the housing thereby preventing reverse or further rotation of the connector body which could lead to disengagement from the housing. Various sealing features are utilized to seal between the housing and connector body itself, and where required, to compress the seals between the mating surfaces.

Locking of the connector to the housing typically requires long radial lock-arms often seen on lamp sockets and mating lock towers molded into the parts. These long lock aims complicate the sealing methods which accompany the design. Also, the long lock arms are a source of several quality issues as variations and processing conditions cause minor shrink differences that effect final arm position. These features can complicate the design and overall tooling process, thereby increasing the cost of manufacturing. Moreover, complicated designs are often not robust and sacrifice the environmental integrity of the controlled environment or chamber within the headlamp.

SUMMARY OF THE INVENTION

A pass-thru electrical connector assembly is an integral part of a barrier wall which separates a harsh environment from a controlled environment. A connector body having a staged position and a locked position on the barrier wall has a flange which extends radially outward from one end of an axial projecting portion. Via rotation of the connector body from the staged position to the locked position, the projecting portion of the connector body moves axially forward through a hole of the barrier wall as a ring seal is preferably axially compressed between the flange and one side of the barrier wall. Axial movement of the connector body is achieved via a plurality of locking lugs which protrude radially outward from and are spaced circumferentially about the projecting portion of the connector body.

The lugs align circumferentially with a plurality of slots spaced about and communicating with the hole of the barrier wall so that the lugs pass through the slots when the connector body is initially inserted into the hole. A flex lock cantilevered from the projecting portion and disposed between two of the locking lugs bends radially inward, during initial insertion of the connector body into the hole, to engage a perimeter surface of the barrier wall which defines the hole and slots. Rotation of the connector body within the hole off sets or circumferentially misaligns the locking lugs from the slots, causing the lugs to ride-up upon an opposite side of the barrier wall moving the connector body forward axially. Simultaneously, the flex lock snaps radially outward into one of the slots preventing reverse rotation of the connector body and thereby locking the connector body to the barrier wall.

An advantage of the present invention is the prevention of accidental disengagement of the connector body from the barrier wall. Yet another advantage is the plurality of slots which serve a dual purpose, first, to allow insertion of the locking lugs, and second to provide a radially extending engagement surface for the flex lock. This robust design simplifies tooling design and manufacturing costs and insures a more reliable seal between the electrical connector body and the barrier wall.

BRIEF DESCRIPTION OF THE DRAWINGS

The presently preferred embodiment of the invention is disclosed in the following description and the accompanying drawings, wherein.

DETAILED DESCRIPTION OF THE PREFERRED EMBODIMENTS

Figure 1:
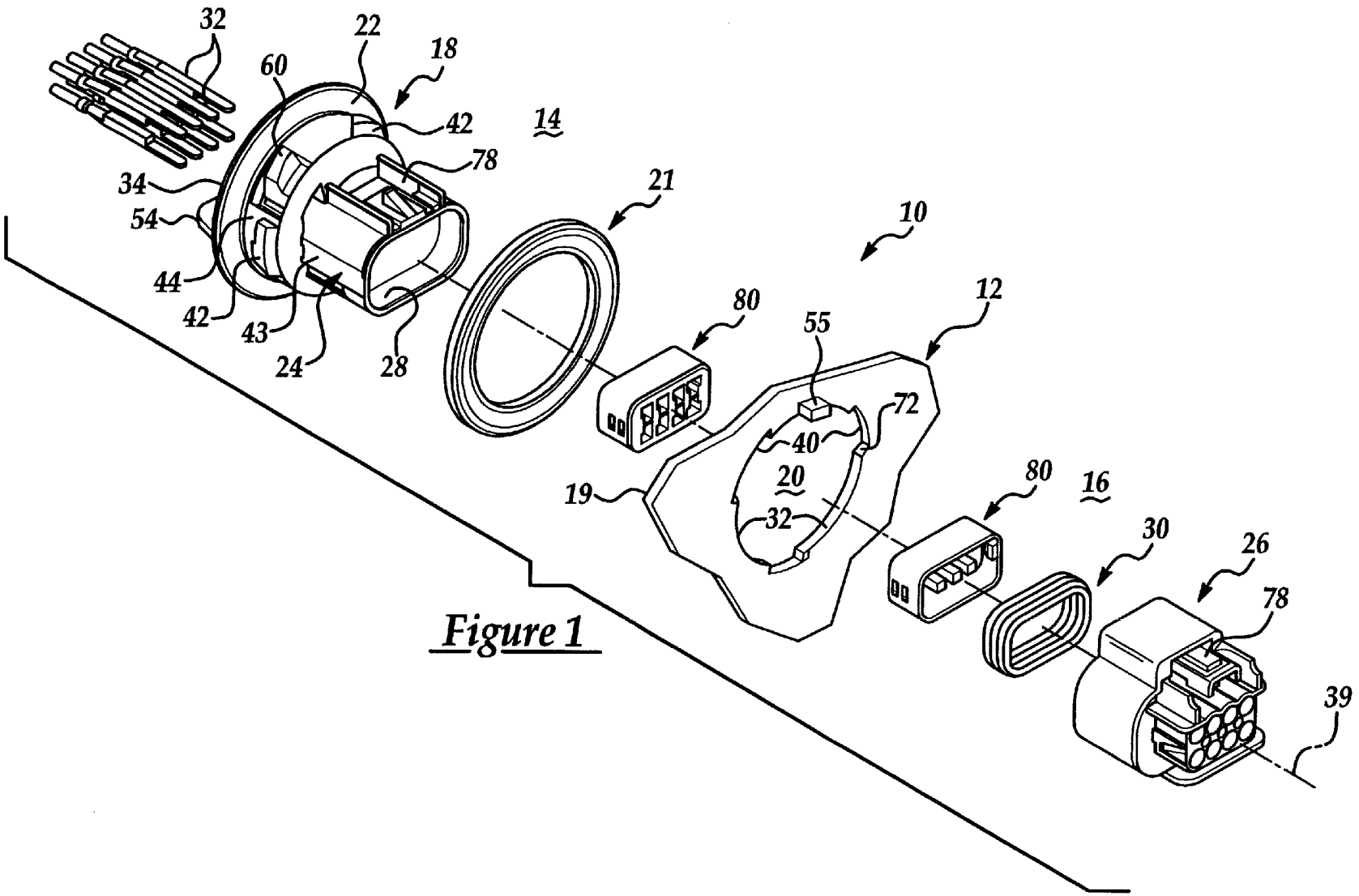
FIG. 1 is an exploded perspective view of a pass-thru electrical connector assembly of the present invention.

Referring now to FIG. 1, a pass-thru electrical connector assembly 10 is an integral part of a barrier wall 12 which separates a controlled environment 14 from a harsh environment 16. The barrier wall 12 may be that of any variety of housings such as a headlamp housing or a control modular housing within an automotive application. In an automotive headlamp application, the controlled environment 14 is then the headlamp chamber encased by the housing or barrier wall 12. A connector body 18 of the assembly 10 inserts axially through a hole 20 of the barrier wall 12 from the controlled environment side 14. The connector body 18 sealably engages the barrier wall 12 via a seal ring 21 which is axially compressed between a radially outward extending flange 22 of the connector body 18 and a rearward side 19 of the wall 12 exposed to the controlled environment 14. An axial projecting portion 24 of the connector body 18 projects substantially concentrically from the flange 22 about a centerline 39 and through the hole 20. The projecting portion 24 has a plug 43 and an annular shoulder 44 engaged axially concentrically between the flange 22 and the plug 43, so that when the connector assembly is fully assembled, the shoulder 44 is substantially aligned axially to the barrier wall 12 within the hole 20 and the plug 43 is disposed within the harsh or un-controlled environment 16. Generally, the flange 22 is disposed radially outward from the annular shoulder 44 which in-turn is disposed radially outward from the plug 43 of the projection portion 24. A sealed female housing 26 engages the plug 43 within the harsh environment 16. Engaged between an interior seal surface 28 of the plug 43 and an interior structure (not shown) of the female housing 26 is a connector seal 30. The seal ring 21, the connector seal 30, and the sealed female housing 26 together assure that the controlled environment 14 is isolated from the harsh environment 16.

Figure 2:
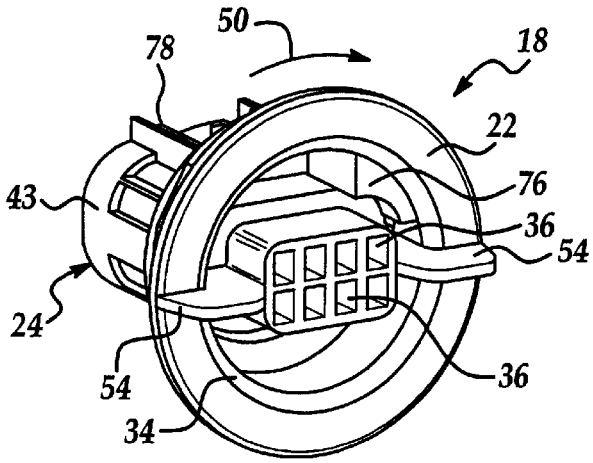
FIG. 2 is a perspective rear view of a connector body of the pass-thru electrical connector assembly.

A series of unsealed male terminals 32 are inserted at a rearward end 34 of the connector body 18 into a corresponding series of unsealed terminal slots 36, as best shown in FIG. 2. Referring to FIGS. 1–12, a perimeter surface 38 carried by the barrier wall 12 is centered about centerline 39 and defines the hole 20 and a series of elongated slots 40 which extend circumferentially and communicate laterally or radially inward with the hole 20 and are spaced circumferentially away from one another.

Figure 5:
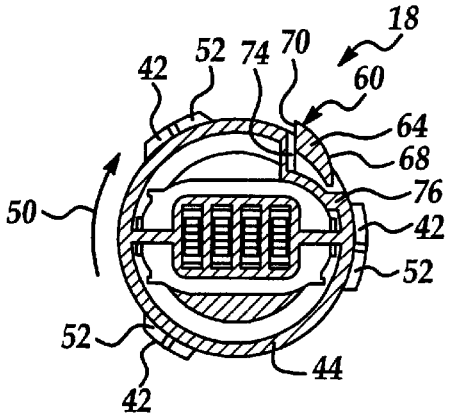
FIG. 5 is a cross section view of the electrical connector body taken along line 5—5 of FIG. 4 viewing in the direction of the arrows.
Figure 6:
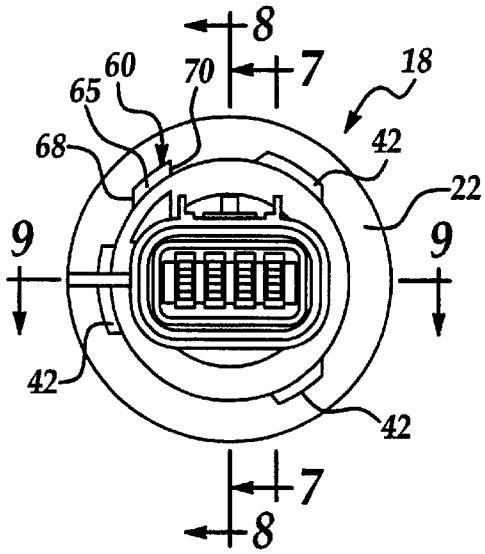
FIG. 6 is a front view of the electrical connector body.
Figure 7:
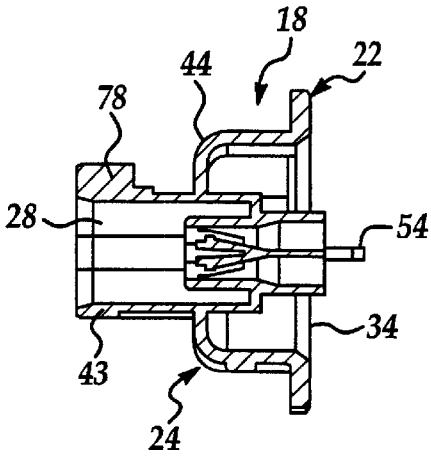
FIG. 7 is a longitudinal cross section view of the electrical connector body taken along line 7—7 of FIG. 6 viewing in the direction of the arrows.
Figure 8:
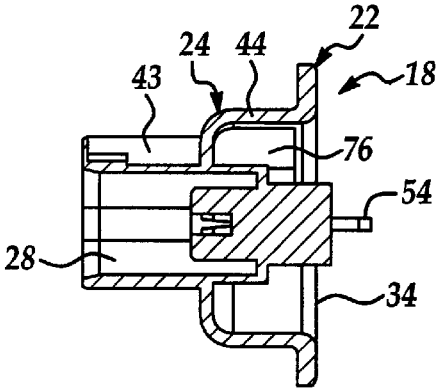
FIG. 8 is a longitudinal cross section view of the electrical connector body taken along line 8—8 of FIG. 6 viewing in the direction of the arrows.
Figure 9:
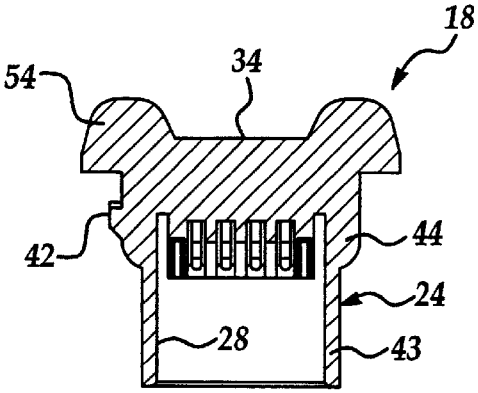
FIG. 9 is a longitudinal cross section view of the electrical connector body taken along line 9—9 of FIG. 6 viewing in the direction of the arrows.
Figure 10:
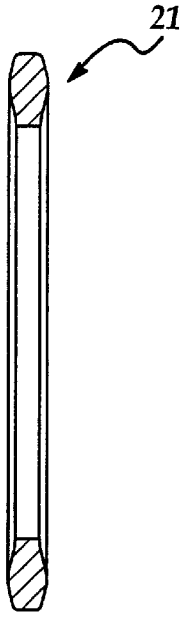
FIG. 10 is a cross section view of a seal ring of the pass-thru electrical connector assembly.
Figure 11:
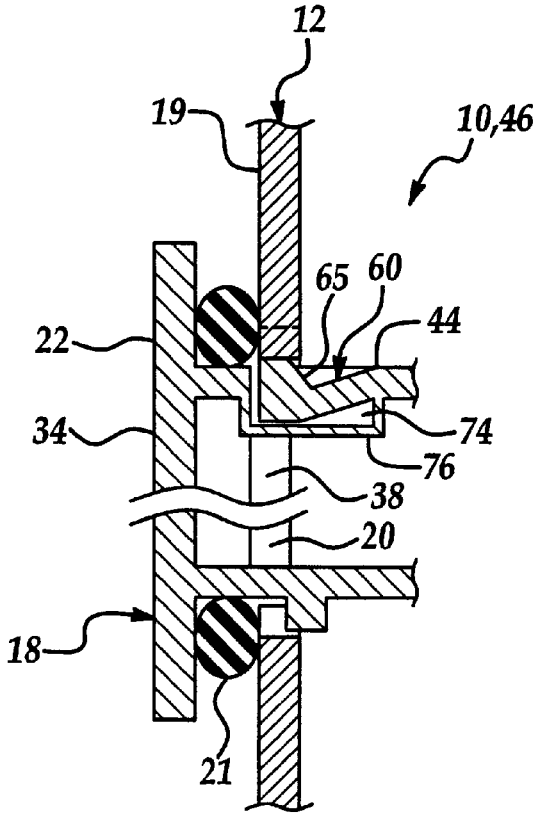
FIG. 11 is a fragmentary longitudinal cross section view of the pass-thru electrical assembly illustrating the electrical connector body in a staged position.
Figure 12:
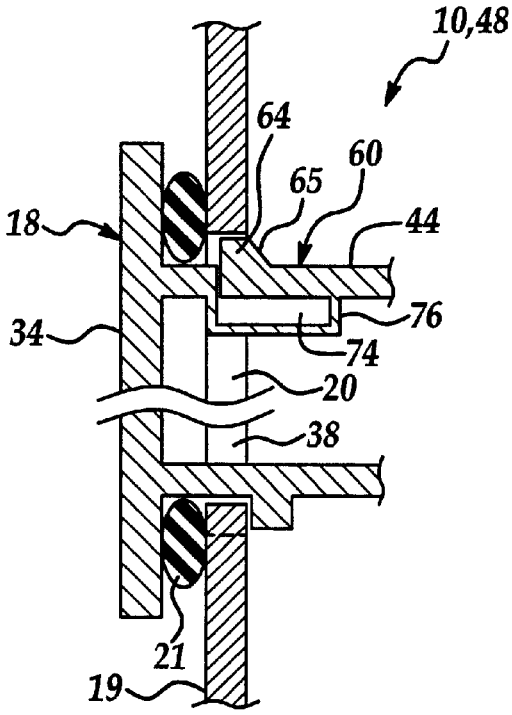
FIG. 12 is a fragmentary longitudinal cross section view of the pass-thru electrical connector assembly illustrating the electrical connector body in a locked position with respect to a barrier wall of the assembly.

The connector body 18 has a staged position 46 with respect to barrier wall 12, as best shown in FIG. 11, and a locked position 48, as best shown in FIG. 12. To initially establish the staged position 46, a series of locking lugs 42 which project radially outward from the annular shoulder 44 of the projecting portion 24 align circumferentially with the respective slots 40 of the barrier wall 12. The locking lugs 42 pass through the slots 40 when the male portion 24 of the connector body 18 is inserted through the hole 20. The connector body 18 is in the staged position 46 when the seal ring 21 is initially engaged axially between, or is in very close proximity to both, the flange 22 and the rearward side 19 of the barrier wall 12. Moreover, when in the staged position 46, the locking lugs 42 are disposed substantially forward of the barrier wall 12 although they are still aligned circumferentially to the slots 40. As illustrated in FIGS. 5 and 6, there are preferably three circumferentially spaced locking lugs 42.

Figure 3:
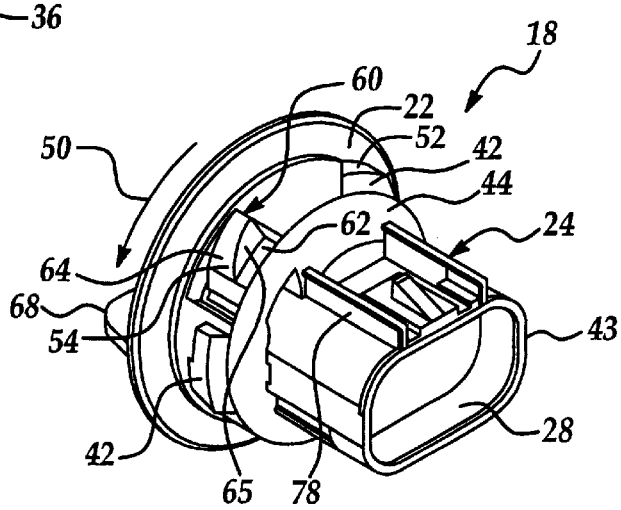
FIG. 3 is a perspective front view of the electrical connector body.
Figure 4:
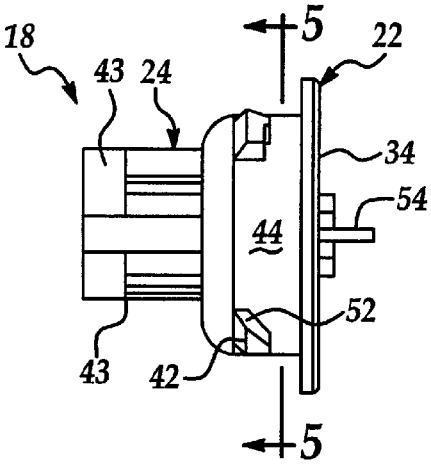
FIG. 4 is a side view of the electrical connector body.

The ring seal 21 compresses axially when the connector body 18 is rotated from the staged position 46 of FIG. 11 into the locked position 48 of FIG. 12. The direction of locking rotation is illustrated by arrow 50, as best shown in FIGS. 2 and 3. The axial compression during rotation is caused by a leading slope surface 52 carried on each locking lug 42. The sloped surfaces 52 ride up upon the side of the barrier wall 12 facing the harsh environment 16 as the connector body 18 rotates in direction 50. This sliding engagement forces the connector body 18 to move axially forward further into the harsh environment 16 compressing the resilient ring seal 21 axially.

Two diametrically opposing thumb tabs 54, extending axially rearward from the rearward end 34 of the connector body 18, will assist the assembler in the rotational engagement of the connector body 18 to the barrier wall 12. If the barrier wall 12 is part of a headlamp housing, access to the thumb tabs 54 is gained prior to establishing the controlled environment 14. That is, if the pass through connector assembly 10 is part of an automotive headlamp assembly, the connector body 18 is rotated via the thumb tabs 54 prior to securing the lens of the headlamp to the housing.

Locking rotation direction 50 of the connector body 18 is limited by a protuberance 55 disposed adjacent to the hole 20 between two of the slots 40 and projecting forward into the harsh environment 16. That is, when a leading surface of the locking lug 42 engages the protuberance 55, the connector body 18 is restricted from further rotation thereby assuring lugs 42 don't realign to the adjacent series of slots 40 from over-rotation which would disengage the connector body 18 from the barrier wall 12.

The connector body 18 is locked within the hole 20 of the barrier wall 12 via a flex lock 60 which prevents reverse rotation from the locked position 48 of FIG. 12 back to the staged position 46 of FIG. 11. An arm 62 of the flex lock 60 projects axially rearward along the annular shoulder 44 and is substantially flush with the outer radial surface of the annular shoulder 44, as best shown in FIG. 3. From a distal end of the arm 62, a head 64 projects radially outward. The head is disposed axially between the flange 22 of the connector body 18 and the locking lugs 42. Referring to FIGS. 6 and 11, an axially leading surface 65 carried by the head 64 engages the barrier wall 12 when the connector body 18 is initially inserted into the hole 20 forcing the flex lock 60 to bend radially inward. The head 64 also has a rotational leading surface 68 which is chamfered to assist rotation of the connector body 18 from the staged position 46 to the locked position 48, as best shown in FIGS. 3 and 5.

Referring to FIGS. 1, 3 and 5, the head 64 of the flex lock 60 carries a rotational trailing stop surface 70 which engages a contact end surface 72 of the perimeter surface 38 to prevent reverse rotation of the connector body 18 and subsequent disengagement when the connector body 18 is in the locked position 48. Because the arm 62 of the flex lock 60 is flush with the annular shoulder 46 when the connector body 18 is in the locked position 48, the arm 62 is flexed radially into a recess 74 when the connector body 18 is in the staged position 46. The recess 74 is carried by the annular shoulder 44 of the projecting portion 24 and is defined by a recess wall 76 which isolates the harsh environment 16 from the controlled environment 14.

A snap lock feature 78 is engaged operatively between the plug 43 of the projecting portion 24 and the female housing 26. The snap lock feature serves to engage sealably the female housing 26 to the plug 43 of the connector body 18 by axially compressing the connector seal 30 there between. Both the connector body 18 an the female housing 26 have identical core reinforcements 80 mounted inside.

While the forms of the invention herein disclosed constitute a presently preferred embodiment, many others are possible. It is not intended herein to mention all the possible equivalent forms or ramifications of the invention. It is understood that the terms used herein are merely descriptive rather than limiting and that various changes may be made without departing from the spirit or scope of the invention.

I claim:

1. A pass-thru electrical connector assembly extending through a barrier wall disposed between a harsh environment and a controlled environment, the pass-thru electrical connector assembly comprising:

the barrier wall having a perimeter surface defining a hole extended axially through the barrier wall and a plurality of slots disposed radially outward from, communicating with, and spaced circumferentially about the hole; and a connector body having:

a flange projecting radially outward beyond the hole of the wall and disposed axially rearward from the barrier wall, a projecting portion extending axially from the flange and through the barrier wall, a plurality of locking lugs projecting radially outward from the projecting portion, a flex lock cantilevered from the projecting portion, a staged position wherein the projecting portion extends through the hole, each one of the plurality of locking lugs are aligned circumferentially to and disposed axially forward from a respective one of the plurality of slots of the barrier wall, and the flex lock is disposed circumferentially between two adjacent slots of the plurality of slots, and engaged resiliently to the perimeter surface of the wall, and a locked position wherein the plurality of lock lugs are misaligned circumferentially to the plurality of slots and are disposed axially forward from and engaged resiliently to the barrier wall, and wherein the flex lock is disposed substantially within one of the plurality of slots.

2. The pass-thru electrical connector assembly as set forth in claim 1 further comprising a centerline extended axially, wherein the connector body is rotated about the centerline when moved from the staged position to the locked position.

3. The pass-thru electrical connector assembly set forth in claim 2 comprising a ring seal resiliently engaged axially between the flange and the barrier wall.

4. The pass-thru electrical connector assembly set forth in claim 3 comprising a protuberance extending axially forward from the barrier wall and disposed adjacent to the hole and circumferentially between two of the plurality of slots, and wherein one of the plurality of lock lugs circumferentially engage the protuberance preventing further rotation of the connector body with respect to the barrier wall when the connector body is in the locked position.

5. The pass-thru electrical connector assembly set forth in claim 4 wherein the connector body has an interior wall defining a flex recess, and wherein the flex lock is flexed resiliently into the flex recess when the connector body is in the staged position and is biased radially outward from the recess when the connector body is in the locked position.

6. The pass-thru electrical connector assembly set forth in claim 5 comprising:

the plurality of slots each having a contact end surface carried by the perimeter surface of the barrier wall; and the flex lock of the connector body having a trailing stop surface for engaging the contact end surface of one of the plurality of slots preventing rotational disengagement of the connector body from the barrier wall.

7. The pass-thru electrical connector assembly set forth in claim 6 wherein the flex lock is cantilevered circumferentially from the projecting portion.

8. The pass-thru electrical connector assembly set forth in claim 7 wherein the trailing stop surface of the flex lock is a circumferential distal end surface of the flex lock and lies within an imaginary plane disposed parallel to the centerline of rotation.

9. The pass-thru electrical connector assembly set forth in claim 8 wherein the flex lock has an arm and a distal head, the arm engaged between the projecting portion of the connector body and the head, the head projected radially outward from the arm, and wherein the head carries the trailing stop surface and a chamfered surface facing axially forward and radially outward to assist in the initial inward flexing of the arm.

10. The pass-thru electrical connector assembly set forth in claim 9 comprising a sealed female housing engaged to and disposed about the projecting portion of the connector body.

11. The pass thru electrical connector assembly set forth in claim 10 comprising:

an interior seal surface of the projecting portion disposed circumferentially about the centerline; and a connector seal engaged resiliently between the interior seal surface of the connector body and the sealed female housing.

12. The pass thru electrical connector assembly set forth in claim 11 comprising a snap lock feature constructed and arranged to engage the projecting portion of the connector body to the female housing compressing the connector seal there between.

13. The pass thru electrical connector assembly set forth in claim 12 comprising:

the connector body having a rearward end and a male terminal slot communicating axially through the rearward end; and an unsealed male terminal disposed within the terminal slot of the connector body.

14. The pass thru electrical connector assembly set forth in claim 13 wherein the rearward end of the connector body is disposed within the controlled environment and the female housing is disposed within the harsh environment.

15. The pass thru electrical connector assembly set forth in claim 14 comprising thumb tabs projecting rearward from the rearward end of the connector body.

* * * * *